US012329250B2

(12) United States Patent
Nakatsuka

(10) Patent No.: US 12,329,250 B2
(45) Date of Patent: Jun. 17, 2025

(54) CONNECTOR, BAND AND TIMEPIECE

(71) Applicant: CASIO COMPUTER CO., LTD., Tokyo (JP)

(72) Inventor: Yoshiki Nakatsuka, Higashiyamato (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 638 days.

(21) Appl. No.: 17/412,463

(22) Filed: Aug. 26, 2021

(65) Prior Publication Data

US 2022/0061475 A1 Mar. 3, 2022

(30) Foreign Application Priority Data

Aug. 27, 2020 (JP) ..... 2020-143331

(51) Int. Cl.

| | |
|---|---|
| ***A44C 5/14*** | (2006.01) |
| ***A44C 5/10*** | (2006.01) |
| ***A44C 5/18*** | (2006.01) |
| ***G04B 37/16*** | (2006.01) |

(52) U.S. Cl.

CPC ..... *A44C 5/147* (2013.01); *A44C 5/107* (2013.01); *A44C 5/185* (2013.01)

(58) Field of Classification Search

CPC ..... A44C 5/147; A44C 5/107; A44C 5/185; A44C 5/14; A44C 5/2052; A44C 5/2061

See application file for complete search history.

(56) References Cited

U.S. PATENT DOCUMENTS

| | | | | |
|---|---|---|---|---|
| 2,007,538 | A * | 7/1935 | Kraemer | G04B 37/1493 24/265 B |
| 4,564,308 | A * | 1/1986 | Ikegami | G04B 37/1493 968/360 |
| 11,464,301 | B2 * | 10/2022 | Pesenti | G04B 37/1493 |
| 11,779,087 | B2 * | 10/2023 | Yamashita | A44C 5/14 24/265 WS |
| 2015/0107300 | A1 * | 4/2015 | Chan | A44C 5/107 63/4 |
| 2022/0163928 | A1 * | 5/2022 | Hata | G04G 17/06 |

FOREIGN PATENT DOCUMENTS

| | | | |
|---|---|---|---|
| CN | 207855186 | U | 9/2018 |
| JP | S58134921 | U | 9/1983 |
| JP | H07-303506 | A | 11/1995 |
| JP | H1023908 | A | 1/1998 |

(Continued)

OTHER PUBLICATIONS

Notice of First Office Action dated Mar. 13, 2023 received in Chinese Patent Application No. CN 202110990979.1.

(Continued)

*Primary Examiner* — Jack W Lavinder

(74) *Attorney, Agent, or Firm* — Scully, Scott, Murphy & Presser, P.C.

(57) ABSTRACT

A connector including a cylindrical member which has a stopper provided on an end and an opening provided in an outer circumferential surface while extending to the end along an axial direction, a slide member arranged in the cylindrical member, and an operation member attached to the slide member through the opening of the cylindrical member.

18 Claims, 6 Drawing Sheets

(56) References Cited

FOREIGN PATENT DOCUMENTS

| | | | | |
|---|---|---|---|---|
| JP | H11146804 | A | | 6/1999 |
| JP | 3530578 | B2 | | 5/2004 |
| JP | 2004-187978 | A | | 7/2004 |
| JP | 2016010571 | A | | 1/2016 |
| JP | 2018038470 | A | * | 3/2018 |
| JP | 6727995 | B2 | | 7/2020 |
| JP | 2020-168218 | A | | 10/2020 |

OTHER PUBLICATIONS

Notice of Reasons for Refusal dated Aug. 4, 2022 received in Japanese Patent Application No. JP 2020-143331.

* cited by examiner

CONNECTOR, BAND AND TIMEPIECE

CROSS-REFERENCE TO RELATED APPLICATION

This application is based upon and claims the benefit of priority from the prior Japanese Patent Application No. 2020-143331, filed Aug. 27, 2020, the entire contents of which are incorporated herein by reference.

BACKGROUND

1. Technical Field

The technical field relates to a connector that is used for bands of wristwatches, clothes, briefcases, handbags, or the like, a band having the connector, and a timepiece having the band.

2. Description of the Related Art

A wristwatch is known which has a structure where push buttons and cam cylinders are provided in a band attachment section of a wristwatch case, and the ends of a connecting pin provided in an end portion of a band are attached to the cam cylinders with the cam cylinders being rotated by push operations performed on the push buttons, whereby the band is attached to the band attachment section of the wristwatch case, as described in Japanese Patent Application Laid-Open (Kokai) Publication No. 07-303506.

SUMMARY

One embodiment is a connector comprising: a cylindrical member which has a stopper provided on an end of the cylindrical member and an opening provided in an outer circumferential surface of the cylindrical member while extending to the end along an axial direction; a slide member arranged in the cylindrical member; and an operation member attached to the slide member through the opening of the cylindrical member.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment of a wristwatch will hereinafter be descried with reference to FIG. 1 to FIG. 6.

Figure 1:
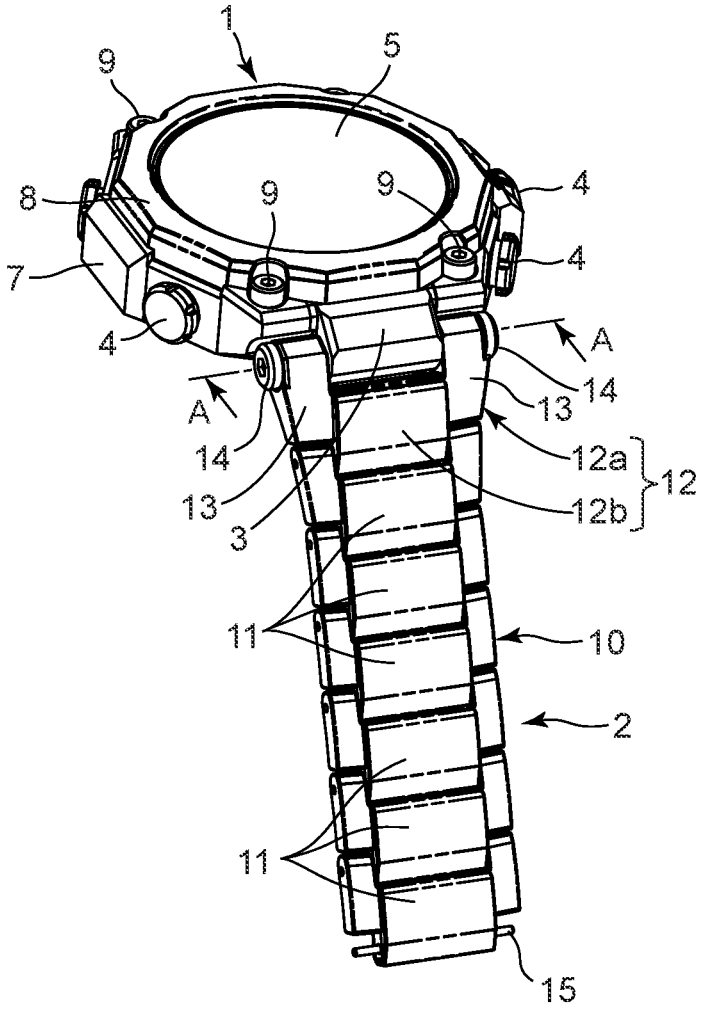
FIG. 1 is an enlarged perspective view showing an embodiment of a wristwatch.
Figure 2:
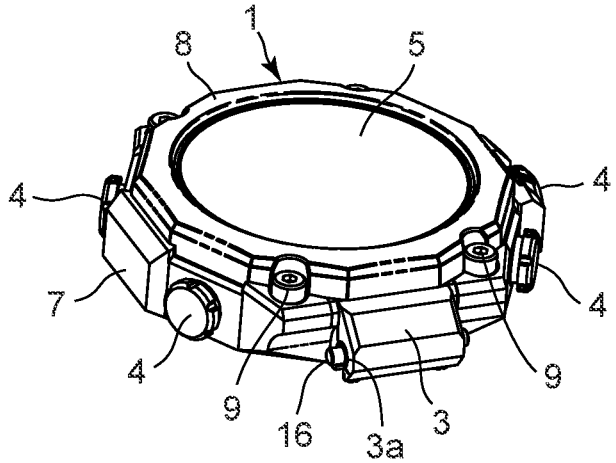
FIG. 2 is an enlarged perspective view of a wristwatch case shown in FIG. 1.

This wristwatch has a wristwatch case 1, as shown in FIG. 1 and FIG. 2. On the twelve o'clock side and six o'clock side of the wristwatch case 1, band attachment sections 3 to which watchbands 2 are attached are provided. Also, on the two o'clock side, three o'clock side, four o'clock side, eight o'clock side and ten o'clock side of the wristwatch case 1, switch devices 4 are provided, respectively.

To the upper opening of the wristwatch case 1, a watch glass 5 is attached via a packing (not shown), as shown in FIG. 1 and FIG. 2. Inside the wristwatch case 1, a timepiece module (not shown) is provided. This timepiece module has various components which are necessary for actualizing timepiece functions, such as a timepiece movement for driving pointers, a display panel for electro-optically displaying information including time information, and a circuit section for electrically driving these sections.

Figure 3:
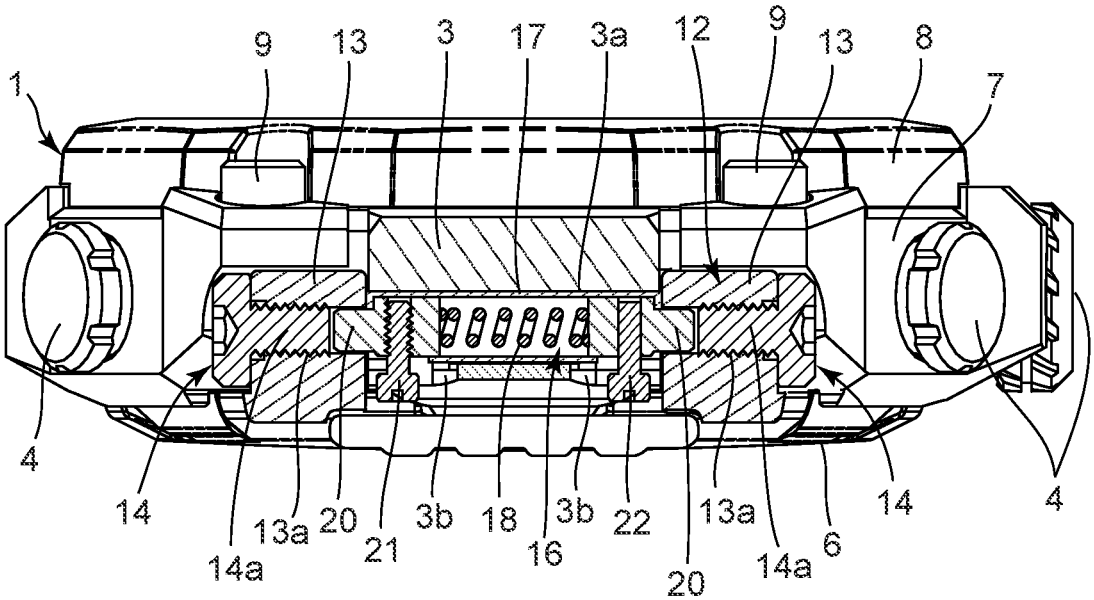
FIG. 3 is an enlarged side view showing a main portion of the wristwatch taken along the A-A arrow view in FIG. 1.

The wristwatch case 1 includes a case main body 6 (refer to FIG. 3) made of synthetic resin, a first exterior case 7 which is made of metal and covers the outer circumference of the case main body 6, and a second exterior case 8 which is also made of metal and covers the upper parts of the case main body 6 and the first exterior case 7, as shown in FIG. 1 to FIG. 3. The case main body 6 is formed in a substantially cylindrical pan shape having a bottom part.

The first exterior case 7 is structured to be arranged covering the outer circumference of the case main body 6 and to hold this case main body 6, as shown in FIG. 1 and FIG. 2. On the twelve o'clock side and six o'clock side of the first exterior case 7, the band attachment sections 3 are provided. The second exterior case 8 is formed in a substantially ring shape and structured such that the watch glass 5 is fitted thereinto. This second exterior case 8 is arranged covering the upper parts of the case main body 6 and the first exterior case 7, and attached to the first exterior case 7 by a plurality of screw members 9.

Each watch band 2 includes a band main body 10 acquired by a plurality of band pieces 11 being sequentially connected to one another, as shown in FIG. 1 and FIG. 3. This band main body 10 includes a connection piece 12 which is connected to one end of the plurality of sequentially connected band pieces 11 and attached to the corresponding band attachment section 3 of the wristwatch case 1. The connection piece 12 includes a connection recess section 12*a* which is attached to the band attachment section 3, and a connection projection section 12*b* which is connected to one of the band pieces 11 at one end of the watch band 2.

On the other hand, the band attachment sections 3 of the wristwatch case 1 are projection sections projecting diagonally downward from the twelve o'clock side and six o'clock side of the outer circumferential surface of the first exterior case 7, and each of which is structured to be arranged in the corresponding connection recess section 12*a*, as shown in FIG. 1 to FIG. 3. In each band attachment section 3, an attachment hole 3*a* is provided penetrating in a width direction perpendicular to a longitudinal direction of the corresponding band main body 10 which is a connection direction of its band pieces 11. Also, in side portions of the undersurface of this band attachment section 3 in the width direction perpendicular to the longitudinal direction of the band main body 10, cutout sections 3*b* are provided corresponding to the attachment hole 3*a*.

The connection recess section 12*a* of each connection piece 12 has a pair of attachment arms 13 provided on its sides in the width direction perpendicular to the longitudinal direction of the corresponding band main body 10, as shown in FIG. 1 and FIG. 3. These attachment arms 13 are formed such that the length between their opposing surfaces in the width direction perpendicular to the longitudinal direction of the band main body 10 is substantially equal to the length of the corresponding band attachment section 3 in the width direction. As a result, each connection piece 12 is structured such that the corresponding band attachment section 3 is arranged in its connection recess section 12*a*.

Each of the above-described attachment arms 13 is provided with a connection hole 13*a*, as shown in FIG. 1 and FIG. 3. These connection holes 13*a* of the pair of attachment arms 13 are provided to coaxially correspond to the attachment hole 3*a* of the corresponding band attachment section 3 when this band attachment section 3 is arranged in the connection recess section 12*a*. Each of these connection holes 13*a* is a screw hole into which a decorative screw 14 is screwed, and is formed such that its axial length is longer than the axial length of a screw section 14*a* of the decorative screw 14.

Also, the connection projection section 12*b* of each connection piece 12 is structured to be attached by a pin member 15 to a band piece 11 at one end of the plurality of band pieces 11 corresponding to this connection projection section 12*b* and sequentially connected to one another, as shown in FIG. 1. Each watch band 2 is structured such that the connection piece 12 of its band main body 10 constituted by the plurality of corresponding band pieces 11 being sequentially connected to one another by a plurality of pin members 15 is attached to the corresponding band attachment section 3 by a connection member 16 which is a connector described below.

Figure 4A:
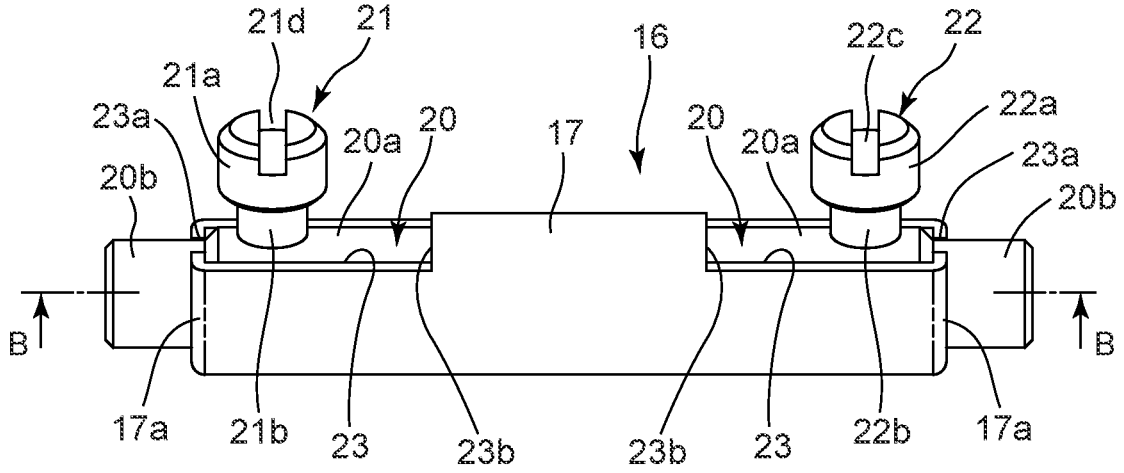
FIG. 4A is an enlarged perspective view of a connection member shown in FIG. 3.
Figure 4B:
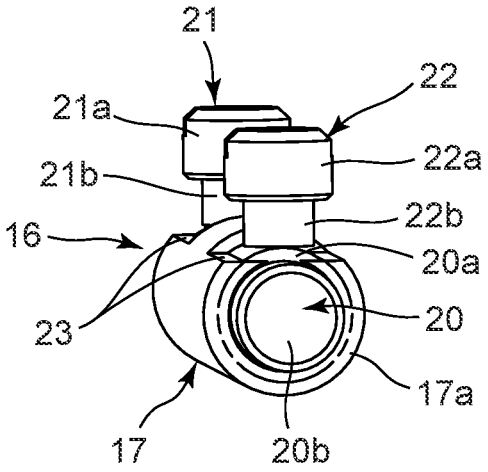
FIG. 4B is an enlarged perspective view of the connection member when viewed from a side in an axial direction.
Figure 5:
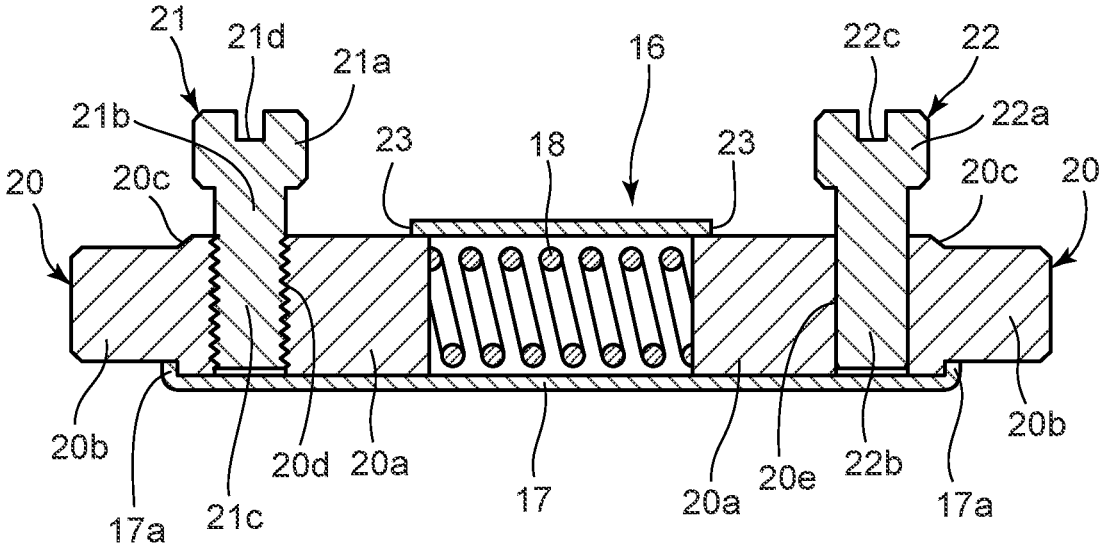
FIG. 5 is an enlarged cross-sectional view showing the connection member taken along the B-B arrow view in FIG. 4A.

Each connection member 16 is a spring rod, and includes a pipe 17 which is a cylindrical member, a spring member 18 arranged in the pipe 17, a pair of slide pieces 20 (slide members) slidably arranged in end portions of the pipe 17, and first and second operation levers 21 and 22 (operation members) for sliding the pair of slide pieces 20, respectively, in the axial directions of the pipe 17, as shown in FIG. 3 to FIG. 5. As a result, this connection member 16 is structured such that, by the spring force of the spring member 18, the slide pieces 20 are pressed toward the outside of the pipe 17 through its ends. The pipe 17, the spring member 18, the pair of slide pieces 20, the first operation lever 21, and the second operation lever 22 described herein are formed of a metal such as titanium or stainless steel. The pipe 17 is formed such that its outer diameter is equal to the inner diameter of the attachment hole 3*a* of the corresponding band attachment section 3, and its axial length is equal to or slightly shorter than the axial length of the attachment hole 3*a* of the band attachment section 3, as shown in FIG. 3 to FIG. 5. On the ends of this pipe 17, stopper sections 17*a* are provided by a swaging process.

Each stopper section 17*a* on the ends of the pipe 17 is formed such that its inner diameter is shorter than the inner diameter of the pipe 17 and substantially equal to the inner diameter of the connection hole 13*a* of the corresponding attachment arm 13, as shown in FIG. 3 to FIG. 5. Also, the pipe 17 is structured such that its end portions are exposed toward an area under the corresponding band attachment section 3 through the cutout sections 3*b* in side portions of the band attachment section 3 after this pipe 17 is inserted into the attachment hole 3*a* of the band attachment section 3.

The spring member 18 is a coil spring whose outer diameter is slightly shorter than the inner diameter of the pipe 17 and length in an expansion or contraction direction, that is, axial length is longer than the length between the pair of slide pieces 20 arranged in the pipe 17, as shown in FIG. 3 and FIG. 5. More specifically, the spring member 18 is structured such that its end portions resiliently come in contact with the inner end surfaces of the pair of slide pieces 20 and force these slide pieces 20 toward the outside of the pipe 17 from the inside thereof.

Each of the pair of slide pieces 20 includes a large-diameter section 20*a* and a small-diameter section 20*b* which are made of a metal such as titanium or stainless steel, as shown in FIG. 3 to FIG. 5. The large-diameter section 20*a*, which is slidably arranged in the pipe 17, is formed such that its outer diameter is slightly shorter than the inner diameter of the pipe 17 and its axial length is substantially one-third of the axial length of the pipe 17.

The pair of slide pieces 20 is structured such that, when they are arranged in both end portions of the pipe 17 and each slide piece 20 is forced toward the outside of the pipe 17 by the spring member 18, the stepped surface of its stepped section 20*c* at the boundary between its large-diameter section 20*a* and its small-diameter section 20*b* comes in contact with the corresponding stopper section 17*a* of the pipe 17, whereby each slide piece 20 is not slipped out from the pipe 17, as shown in FIG. 3 to FIG. 5.

The small-diameter section 20*b* of each slide piece 20 is integrally provided on the corresponding stepped sections 20*c* at the outer end of the corresponding large-diameter section 20*a*, as shown in FIG. 3 to FIG. 5. These small-diameter sections 20*b* are structured to retractably protrude outward from the ends of the pipe 17 so as to be inserted into the connection holes 13*a* in the pair of attachment arms 13 of the connection piece 12 of the corresponding watch band 2. That is, the outer diameter of each small-diameter section 20*b* is shorter than the outer diameter of each large-diameter section 20*a* and is substantially equal to the inner diameter of each connection hole 13*a* in the pair of attachment arms 13 and the inner diameter of each stopper section 17*a* of the pipe 17.

In addition, the axial length of each small-diameter section 20*b* is substantially half the axial length of each large-diameter section 20*a* and substantially one-third of the axial length of each connection hole 13*a* in the pair of attachment arms 13, as shown in FIG. 3 to FIG. 5. As a result, each small-diameter section 20*b* is structured to be pressed toward the outside of the pipe 17 when the corresponding large-diameter section 20*a* is pressed by the spring force of the spring member 18, and to be pressed toward the inside of the pipe 17 when pressed against the spring force of the spring member 18.

To the large-diameter sections 20*a* of the pair of slide pieces 20, the first operation lever 21 and the second operation lever 22 are attached through opening sections 23 provided in end portions of the pipe 17, as shown in FIG. 3 to FIG. 5. These first and second operation levers 21 and 22 are used to slide the pair of slide pieces 20 in the axial directions in the pipe 17 against the spring force of the spring member 18.

More specifically, of these first and second operation levers 21 and 22, the first operation lever 21 on the left side of the pipe 17 has a first head section 21*a* and a first shaft section 21*b*, and is structured such that the first shaft section 21*b* is attached to the left large-diameter section 20*a* through the opening section 23 provided on the left side of the pipe 17, as shown in FIG. 3 to FIG. 5.

This first shaft section 21*b* of the first operation lever 21 is provide with a screw section 21*c*, as shown in FIG. 3 to FIG. 5. As a result, the first operation lever 21 is structured such that the screw section 21*c* is screwed into and attached to a screw hole 20*d* in an end portion of the left large-diameter section 20*a* on the stepped section 20*c* side through the left opening section 23 of the pipe 17.

That is, the first shaft section 21*b* of the first operation lever 21 is attached to an end portion of the left large-diameter section 20*a* on the stepped section 20*c* side, or in other words, an end portion of the large-diameter section 20*a* on the small-diameter section 20*b* side, as shown in FIG. 3 to FIG. 5. In the first head section 21*a* of the first operation lever 21, a groove section 21*d* into which a tool such as a screwdriver is inserted is provided.

As with the first operation lever 21, the second operation lever 22 on the right side of the pipe 17 has a second head section 22*a* and a second shaft section 22*b*, as shown in FIG. 3 to FIG. 5. This second operation lever 22 is structured to be attached to the right large-diameter section 20*a* by the second shaft section 22*b* being inserted into a fixing hole 20*e* in an end portion of the large-diameter section 20*a* on the stepped section 20*c* side through the opening section 23 provided on the right side of the pipe 17.

Also, this second operation lever 22 is structured such that the second shaft section 22*b* inserted into the fixing hole 20*e* in the end portion of the right large-diameter section 20*a* on the stepped section 20*c* side, that is, the small-diameter section 20*b* side is fixed by being welded using a laser beam, as shown in FIG. 3 to FIG. 6. In the second head section 22*a* of this second operation lever 22, a groove section 22*c* into which a tool such as a screwdriver is inserted is provided.

The opening sections 23 are provided in the end portions of the pipe 17 while corresponding to the cutout sections 3*b* provided in the corresponding band attachment section 3 so as to expose end portions of the attachment hole 3*a*, as shown in FIG. 3 to FIG. 5. Each of these opening sections 23 is a long hole formed along an axial direction of the pipe 17.

The axial length of each opening section 23 is equal to or slightly shorter than the slide length of each slide piece 20, that is, the length of the large-diameter section 20*a* of each slide piece 20, as shown in FIG. 3 to FIG. 5. In addition, the length of each opening section 23 in a circumferential direction perpendicular to the axial direction of the pipe 17 is equal to or slightly longer than the outer diameter of the first shaft section 21*b* of the first operation lever 21 or the outer diameter of the second shaft section 22*b* of the second operation lever 22.

Also, each opening section 23 is provided such that its one end portion 23*a* is located at an end of the pipe 17, as shown in FIG. 3 to FIG. 5. More specifically, the one end portions 23*a* of the opening sections 23 are formed at the ends of the pipe 17 by the stopper sections 17*a* of the pipe 17 being partially cut out. That is, each opening section 23 is an opening formed extending to an end of the pipe 17. Consequently, the first operation lever 21 and the second operation lever 22 are structured such that, when the pair of slide pieces 20 is pressed by the spring force of the spring member 18, the first shaft section 21*b* and the second shaft section 22*b* are located at the ends of the pipe 17 where the stopper sections 17*a* have been partially cut out.

Accordingly, the opening sections 23 are formed such that, when the small-diameter sections 20*b* of the pair of slide pieces 20 are pressed toward the outside of the pipe 17 by the spring force of the spring member 18 and the stepped sections 20*c* of the pair of slide pieces 20 come in contact with the stopper sections 17*a* provided on the ends of the pipe 17, the first shaft section 21*b* of the first operation lever 21 and the second shaft section 22*b* of the second operation lever 22 are located at the ends of the pipe 17, as shown in FIG. 3 to FIG. 5.

Figure 6:
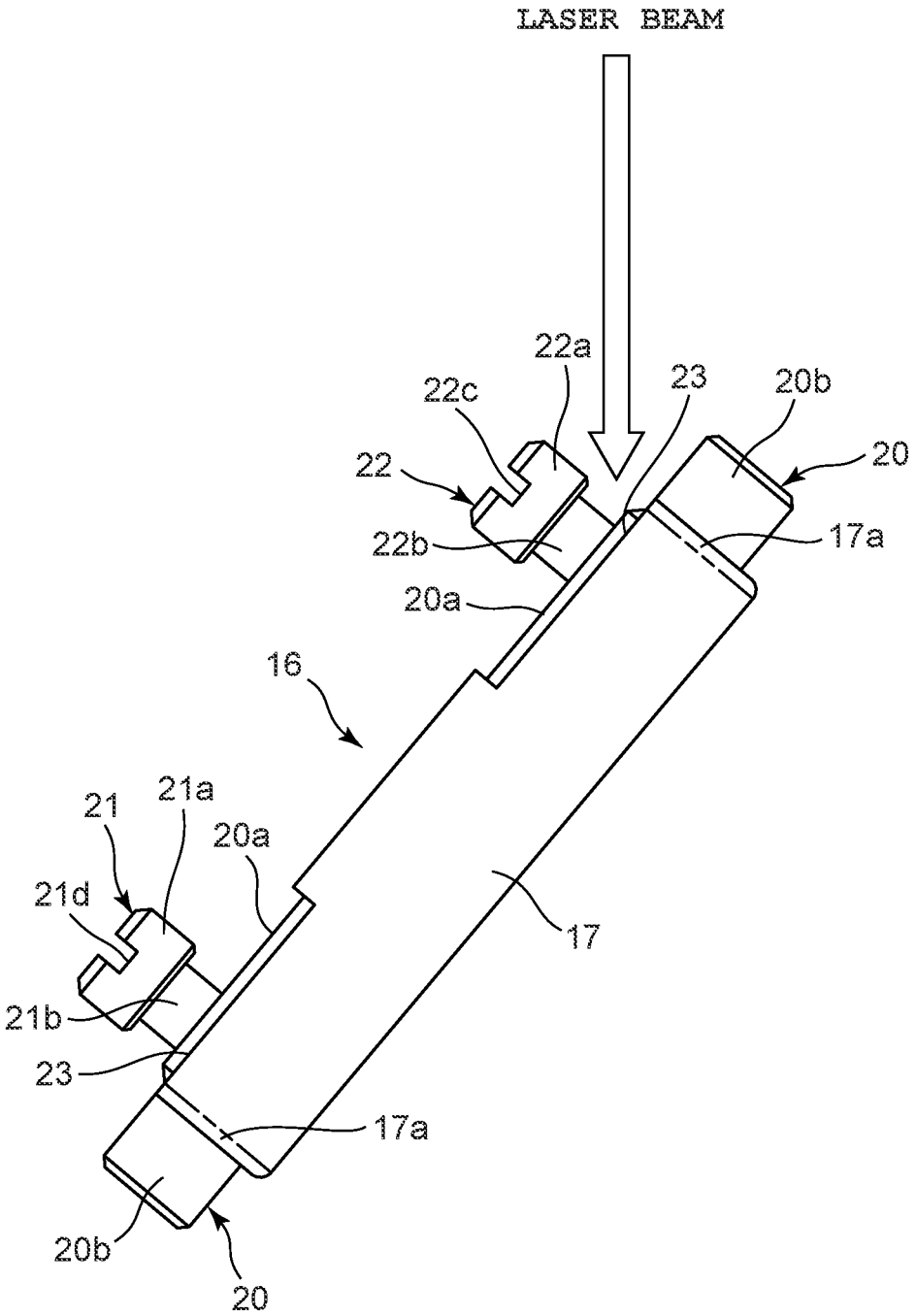
FIG. 6 is an enlarged perspective view showing a state where a second operation lever is welded to a slide piece of the connection member of FIG. 4A by a laser beam.

As a result, the second operation lever 22 is structured such that, when being welded by a laser beam with the pair of slide pieces 20 being pressed by the spring force of the spring member 18 and the first shaft section 21*b* and the second shaft section 22*b* being positioned at the ends of the pipe 17 where the stopper sections 17*a* have been partially cut out, this second operation lever 22 is easily welded through the portion of the pipe 17 where the corresponding stopper section 17*a* has been partially cut out, as shown in FIG. 6.

Also, the opening sections 23 are formed such that, when the small-diameter sections 20*b* of the pair of slide pieces 20 are pressed into the pipe 17 against the spring force of the spring member 18, the first shaft section 21*b* of the first operation lever 21 and the second shaft section 22*b* of the second operation lever 22 are positioned close to or come in contact with the other end portions 23*b* of the opening sections 23 located close to the middle of the pipe 17 in the axial direction, as shown in FIG. 3 to FIG. 5.

Next, the assembly of the above-described wristwatch and the watch bands 2 is described.

When the wristwatch case 1 is to be assembled in the assembly of the wristwatch, first, the case main body 6 is arranged and held in the first exterior case 7. In this state, the timepiece module is attached to the case main body 6, and the switch devices 4 are attached to the outer circumferential portions of the first exterior case 7.

In this state, the second exterior case 8 is arranged on the upper parts of the case main body 6 and the first exterior case 7. Here, before this arrangement, the watch glass 5 is attached to the second exterior case 8. Then, in this state, the second exterior case 8 is attached to the upper part of the first exterior case 7 by the plurality of screw members 9. As a result, the wristwatch case 1 is assembled.

Next, each watch band 2 is attached to the wristwatch case 1. Here, before this attachment, the band main body 10 is assembled for each watch band 2. More specifically, the band pieces 11 are successively connected to one another by the pin components 15, and the connection piece 12 is connected to the band piece 11 serving as one end of the plurality of connected band pieces 11. Here, the connection projection section 12*b* of the connection piece 12 is connected to the band piece 11 serving as one end of the plurality of band pieces 11 by the pin component 15. By this procedure being repeated, each watch band 2 is assembled.

Next, each watch band 2 is attached to the corresponding band attachment section 3 of the wristwatch case 1. Here, before this attachment, each connection member 16 is assembled and arranged in the attachment hole 3*a* of the corresponding band attachment section 3. In this assembly of the connection member 16, first, the opening sections 23 are formed in both end portions of the pipe 17 along the axial direction. In addition, the screw hole 20*d* is formed in the large-diameter section 20*a* of one of the pair of slide pieces 20, and the fixing hole 20*e* is formed in the large-diameter section 20*a* of the other slide piece 20.

Next, the spring member 18 is inserted into the pipe 17. Then, the pair of slide pieces 20 is inserted into the end portions of the pipe 17 and, in this state, the stopper sections 17*a* are formed on the ends of the pipe 17 by a swaging process. Consequently, the large-diameter sections 20*a* of the pair of slide pieces 20 are forced toward the outside of the pipe 17 by the spring force of the spring member 18 in the pipe 17 and come in contact with the stopper sections 17*a* on the ends of the pipe 17, whereby the small-diameter sections 20*b* protrude outside of the ends of the pipe 17.

In this state, the second operation lever 22 is inserted into the fixing hole 20*e* in the large-diameter section 20*a* of one of the slide pieces 20 from the corresponding opening section 23 of the pipe 17, and then attached to this large-diameter section 20*a* by a laser beam. Note that, here, the one end portion 23*a* of the opening section 23 has been formed at the end of the pipe 17 by the corresponding stopper section 17*a* of the pipe 17 being partially cut out as described above.

On this second operation lever 22 side, by the pair of slide pieces 20 being pressed by the spring force of the spring member 18, the second shaft section 22*b* has been positioned at the end of the pipe 17 having the partially cut-out stopper section 17*a*. As a result, an outer circumferential portion of the second shaft section 22*b* located at the rim of the fixing hole 20*e* of the large-diameter section 20*a* has been exposed in the opening section 23 of the pipe 17. In this state, the exposed outer circumferential portion of the second shaft section 22*b* is welded by a laser beam along its entire circumference.

In this welding, by the presence of the cut-out portion of the stopper section 17*a* of the pipe 17, the outer circumferential portion of the second shaft section 22*b* is easily welded along its entire circumference. As such, in the case of this connection member 16, the second shaft section 22*b* of the second operation lever 22 is positioned at the end of the pipe having the partially cut-out stopper section 17*a*. Accordingly, the length of the pipe 17 in the axial direction is short and therefore the length of the band attachment section 3 in the width direction perpendicular to the piece connection direction is also short.

Then, the pipe 17 having the second operation lever 22 attached thereto is inserted into the attachment hole 3*a* of the corresponding band attachment section 3 of the wristwatch case 1. In this attachment, one end portion of the pipe 17 which is not yet provided with the first operation lever 21 is inserted into the attachment hole 3*a* of the band attachment section 3 such that the small-diameter section 20*b* of the slide piece 20 protruding from this one end portion of the pipe 17 protrudes outside of the attachment hole 3*a*.

As a result, the large-diameter section 20*a* of the slide piece 20 whose small-diameter section 20*b* is protruding from the one end portion of the pipe 17 not yet provided with the first operation lever 21 and the corresponding opening section 23 of the pipe 17 correspond to the cutout section 3*b* provided in one side portion of the band attachment section 3, and the screw hole 20*d* of the large-diameter section 20*a* corresponds to and is exposed in this cutout section 3*b*.

Also, here, the second shaft section 22*b* of the second operation lever 22 is arranged in the cutout section 3*b* provided in the other side portion of the band attachment section 3, the opening section 23 having the second shaft section 22*b* of the second operation lever 22 inserted thereinto corresponds to the cutout section 3*b* provided in this other side portion of the band attachment section 3, and the small-diameter section 20*b* of the slide piece 20 having the second operation lever 22 attached thereto protrudes outside of the attachment hole 3*a* of the band attachment section 3.

In this state, the first shaft section 21*b* is screwed into the screw hole 20*d* of the large-diameter section 20*a* of the slide piece 20 exposed corresponding to the cutout section 3*b* provided in the one side portion of the band attachment section 3, whereby the first operation lever 21 is attached. By this procedure being repeated, each connection member 16 is assembled, and then attached to the attachment hole 3*a* of the corresponding band attachment section 3.

Each band attachment section 3 to which the corresponding connection member 16 has been attached is arranged in the connection recess section 12*a* of the connection piece 12 of the corresponding watch band 2. Then, the connection piece 12 is attached to this band attachment section 3. In this attachment, first, the first operation lever 21 and the second operation lever 22 are moved in directions to approach each other against the spring force of the spring member 18 in the pipe 17, whereby the pair of slide pieces 20 is slid in directions to approach each other. As a result, the small-diameter sections 20*b* of the pair of slide pieces 20 are pressed into the pipe 17 and thereby arranged in the attachment hole 3*a* of the band attachment section 3.

In this state, the band attachment section 3 is arranged in the connection recess section 12*a* of the connection piece 12 of the watch band 2 such that the connection holes 13*a* of the pair of attachment arms 13 of the connection piece 12 coaxially correspond to the pipe 17 attached to the band attachment section 3. Then, the pair of slide pieces 20 in the pipe 17 is forced and slid toward the outside of the pipe 17 by the spring force of the spring member 18. In addition, in the cutout sections 3*b* in the side portions of band attachment section 3, the first shaft section 21*b* of the first operation lever 21 and the second shaft section 22*b* of the second operation lever 22 in the opening sections 23 in the end portions of the pipe 17 are moved in directions away from each other.

As a result, the small-diameter sections 20*b* of the pair of slide pieces 20 are pushed out of the pipe 17 and inserted into the connection holes 13*a* of the pair of attachment arms 13 of the connection piece 12. Consequently, the watch band 2 is attached to the band attachment section 3 of the wristwatch case 1. In this state, the first operation lever 21 and the second operation lever 22 of the connection member 16 have been arranged to be exposed to an area under the band attachment section 3 through the cutout sections 3*b* of the band attachment section 3.

When each watch band 2 is attached to the corresponding band attachment section 3 as described above, the decorative screws 14 are attached to the connection holes 13*a* of the pair of attachment arms 13 of each connection piece 12. After this attachment, the wristwatch can be used with the wristwatch case 1 being worn on an arm by the watchbands 2. When the wristwatch is being used, the first and second operation levers 21 and 22 arranged to be exposed to an area under the corresponding band attachment section 3 are covered by the arm, and therefore not operated unintentionally.

Also, when each watch band 2 is to be detached from the corresponding band attachment section 3 of the wristwatch case 1, the first operation lever 21 and the second operation lever 22 in the opening sections 23 in the end portions of the pipe 17 are moved in the directions to approach each other, in the cutout sections 3*b* in the side portions of the band attachment section 3. As a result, the first shaft section 21*b* and the second shaft section 22*b* are moved in directions to approach each other against the spring force of the spring member 18 in the pipe 17, whereby the pair of slide pieces 20 is moved in the directions to approach each other.

Consequently, the small-diameter sections 20*b* of the pair of slide pieces 20 are moved out of the connection holes 13*a* in the pair of attachment arms 13 of the connection piece 12 and pressed into the pipe 17 so as to be arranged in the attachment hole 3*a* of the band attachment section 3. By this procedure being repeated, each watch band 2 is detached from the corresponding band attachment section 3 of the wristwatch case 1.

Also, when each connection member 16 is to be detached from the corresponding band attachment section 3, a tool such as a screwdriver is inserted into the groove section 21*d* of the first head section 21*a* of the first operation lever 21 and rotated, whereby the first shaft section 21*b* is removed from the screw hole 20*d* in the large-diameter section 20*a* of the slide piece 20. By this procedure being repeated, each pipe 17 can be taken out from the attachment hole 3*a* of the corresponding band attachment section 3 together with the corresponding second operation lever 22

In the case of the above-described conventional wristwatch disclosed in Japanese Patent Application Laid-Open (Kokai) Publication No. 07-303506, when the cam cylinders are rotated by push operations being performed on the push buttons, cutout sections formed in the cam cylinders are exposed corresponding to cutout sections of the band attachment section, and the ends of the connecting pin provided in the end portion of the band are inserted into the cam cylinders through the exposed cutout sections. In this state, when the push buttons return to their original positions, the cam cylinders are rotated, and the cutout sections of the cam cylinders are covered by the band attachment section, whereby the ends of the connecting pin are not slipped out from the inside of the cam cylinder. However, this structure, in which the connecting pin provided in the end portion of the band is attached to the cam cylinders with the cam cylinders being rotated by push operations performed on the push button, is complicated and therefore enlarges the size of the wristwatch.

In the case of the present embodiment, each connection member 16 of the wristwatch includes the pipe 17 that is a cylindrical member where the stopper sections 17*a* have been provided on the ends and the opening sections 23 respectively extending to these ends have been provided in the outer circumferential surface along the axial direction, the two slide pieces 20 slidably arranged in the pipe 17, and the second operation lever 22 attached to at least one of the two slide pieces 20 through one of the opening sections 23 of the pipe 17. The opening sections 23 are provided such that their one end portions 23*a* are formed in the ends of the pipe 17 by the stopper sections 17*a* being partially cut out. As a result, the structure is simple and downsizing is achieved.

More specifically, in the case of this connection member 16, the one end portions 23*a* of the opening sections 23 are formed in the ends of the pipe 17 by the stopper sections 17*a* being partially cut out. Accordingly, the second operation lever 22 can be attached to the portion of the corresponding slide piece 20 which comes closest to the corresponding stopper section 17*a* of the pipe 17, that is, the end portion of the large-diameter section 20*a* of the slide piece 20 on the small-diameter section 20*b* side. As a result of this structure, the axial length of the pipe 17 can be shortened. That is, by this simple structure, each pipe 17 can be downsized, whereby each band attachment section 3 and the connection piece 12 of each watch band 2 can be downsized.

Also, in the case of this connection member 16, each of the two slide pieces 20 includes the large-diameter section 20*a* which comes in contact with the corresponding stopper section 17*a*, and the small-diameter section 20*b* which retractably protrudes from the corresponding end of the pipe 17. The second operation lever 22 is provided on the end portion of the large-diameter section 20*a* near the stepped section 20*c* located at the boundary between the large-diameter section 20*a* and the small-diameter section 20*b* of the slide piece 20. As a result of this structure, even though the second operation lever 22 is provided on the slide piece 20, the axial length of the pipe 17 can be shortened. That is, by this simple structure, each pipe 17 can be downsized.

Moreover, this connection member 16 includes the spring member 18 which presses and forces the two slide pieces 20 toward the outside of the pipe 17 from the inside thereof. Accordingly, even when the small-diameter sections 20*b* of the pair of slide pieces 20 have been pushed out of the ends of the pipe 17 by the spring force of the spring member 18, one of the small-diameter sections 20*b* which has been pushed out of one end of the pipe 17 can be easily pressed into the pipe 17 without any tool by the second operation lever 22 being operated against the spring force of the spring member 18.

Furthermore, in the case of this connection member 16, the second operation lever 22 can be easily and reliably attached to the corresponding slide piece 20 by being welded using a laser beam. That is, in the case of this connection member 16, the second shaft section 22*b* of the second operation lever 22 can be easily and reliably attached to the large-diameter section 20*a* of the corresponding slide piece 20 by a laser beam being used with the second shaft section 22*b* of the second operation lever 22 being inserted into and positioned in the fixing hole 20*e* provided in the large-diameter section 20*a* of the slide piece 20.

Still further, in the case of this connection member 16, the one end portions 23*a* of the opening sections 23 of the pipe 17 are formed in the ends of the pipe 17 by the stopper sections 17*a* of the pipe 17 being partially cut out. Accordingly, the second shaft section 22*b* of the second operation lever 22 can be arranged at the end of the pipe 17 where the corresponding stopper section 17*a* has been partially cut out.

Thus, in the case of this connection member 16, the outer circumferential portion of the second shaft section 22*b* located at the rim of the fixing hole 20*e* of the corresponding large-diameter section 20*a* can be exposed in the corresponding opening section 23 without being blocked by the edges of the corresponding stopper section 17*a* provided in the end of the pipe 17. As a result, the exposed outer circumferential portion of the second shaft section 22*b* can be easily and favorably welded along the entire circumference by a laser beam.

Also, in the case of this connection member 16, the first and second operation levers 21 and 22 are attached to the two slide pieces 20, respectively. Accordingly, even when the small-diameter sections 20*b* of the pair of slide pieces 20 have been pushed out of the ends of the pipe 17 by the spring force of the spring member 18, the first operation lever 21 and the second operation lever 22 can be operated in the directions to approach each other against the spring force of the spring member 18. As a result of this structure, the small-diameter sections 20*b* of the pair of slide pieces 20 pushed out of the ends of the pipe 17 can be easily pressed into the pipe 17 without any tool.

Moreover, in the case of this connection member 16, the second operation lever 22 of the first and second operation levers 21 and 22 is attached to one of the two slide pieces 20 by welding with a laser beam, and the first operation lever 21 is attached to the other slide piece 20 by being screwed thereinto. Accordingly, in spite of the structure where the first operation lever 21 and the second operation lever 22 are provided on the two slide pieces 20 in the pipe 17, the connection member 16 can be easily attached to or detached from the corresponding band attachment section 3.

More specifically, in the case of this connection member 16, when being attached to the attachment hole 3*a* of the corresponding band attachment section 3, the pipe 17 is inserted into and arranged in the attachment hole 3*a* of the band attachment section 3 with the second operation lever 22 being attached to one of the slide pieces 20 by welding with a laser beam, and then the first operation lever 21 is attached to the other slide piece 20 in this state by being screwed thereinto.

In addition, when the pipe 17 is to be detached from the attachment hole 3*a* of the band attachment section 3, the first operation lever 21 screwed into the other slide piece 20 is unscrewed therefrom, whereby the pipe 17 is easily detached from the attachment hole 3*a* of the band attachment section 3 even though the second operation lever 22 has been attached to the one slide piece 20 by welding with a laser beam.

In the above-described embodiment, the first operation lever 21 and the second operation lever 22 are attached to the pair of slide pieces 20 arranged in the pipe 17 of each connection member 16. However, the present invention is not limited thereto, and a structure may be adopted in which only one of the first operation lever 21 and the second operation levers 22 is attached to one of the pair of slide pieces 20.

Also, in the above-described embodiment, the opening sections 23 are provided in both end portions of the pipe 17 of each connection member 16. However, the present invention is not limited thereto, and a structure may be adopted in which only one end portion of the pipe 17 has an opening section 23.

Moreover, in the above-described embodiment, each band attachment section 3 is arranged in the connection recess section 12*a* of the connection piece 12 of the corresponding band main body 10. However, the present invention is not limited thereto, and a structure may be adopted in which the connection projection section 12*b* of the connection piece 12 of the band main body 10 is arranged in the band attachment section 3. In that structure, the connection member 16 is arranged in the connection piece 12 of the band main body 10.

Furthermore, in the above-described embodiment, the present invention has been applied in a wristwatch. However, the present invention is not necessarily required to be applied in a wristwatch. For example, the present invention is applicable to bands for clothes, briefcases, and handbags.

While the present invention has been described with reference to the preferred embodiments, it is intended that the invention be not limited by any of the details of the description therein but includes all the embodiments which fall within the scope of the appended claims.

What is claimed is:

1. A connector comprising:

a cylindrical member that extends along an axial direction, wherein a cutout is provided at an end of the cylindrical member in the axial direction, and wherein an opening is provided on the cylindrical member to extend along the axial direction towards the end of the cylindrical member;

a stopper provided on the end of the cylindrical member, wherein an inner diameter of the stopper is less than an inner diameter of the cylindrical member;

a slide member comprising:

a large-diameter portion configured to be slidably arranged within the cylindrical member and to come in contact with the stopper; and a small-diameter portion, wherein at least a portion of the small-diameter portion is configured to be retractably protruded past the stopper; and an operation member attached to the large-diameter portion of the slide member through the opening of the cylindrical member, wherein a joint portion of the operation member is welded to an outer surface of the large-diameter portion of the slide member, and wherein a length of the cutout in a circumferential direction perpendicular to the axial direction is sized such that an entire circumference of the joint portion of the operation member welded to the outer surface of the large-diameter portion of the slide member extends past the cutout in a direction radially away from the axial direction to be exposed.

2. The connector according to claim 1, wherein the operation member is provided on an end portion of the large-diameter portion adjacent to a boundary between the large-diameter portion and the small-diameter portion of the slide member.

3. The connector according to claim 2, further comprising:

a spring member configured to force the large-diameter portion of the slide member towards the stopper.

4. The connector according to claim 2, wherein the opening of the cylindrical member is a first opening, and the end of the cylindrical member is a first end, wherein the slide member is a first slide member, wherein the operation member is a first operation member, and wherein the connector further comprises:

a second opening provided at a second end of the cylindrical member along the axial direction;

a second slide member arranged within the cylindrical member; and a second operation member attached to the second slide member.

5. The connector according to claim 4, wherein the first operation member is attached to the first slide member by welding with a laser beam, and wherein the second operation member is attached to the second slide member by being screwed thereinto.

6. The connector according to claim 1, further comprising:

a spring member configured to force the large-diameter portion of the slide member towards the stopper.

7. The connector according to claim 6, wherein the opening of the cylindrical member is a first opening, and the end of the cylindrical member is a first end, wherein the slide member is a first slide member, wherein the operation member is a first operation member, and wherein the connector further comprises:

a second opening provided at a second end of the cylindrical member along the axial direction;

a second slide member arranged within the cylindrical member; and a second operation member attached to the second slide member.

8. The connector according to claim 7, wherein the first operation member is attached to the first slide member by welding with a laser beam, and wherein the second operation member is attached to the second slide member by being screwed thereinto.

9. The connector according to claim 8, wherein a stopper is provided in both end portions of the cylindrical member, and wherein the opening of the cylindrical member is provided such that one end portion is formed in the end of the cylindrical member by the stopper of the cylindrical member being cut out.

10. The connector according to claim 9, wherein the first operation member has a head section and a shaft section, and wherein the first operation member is welded by a laser beam with a pair of the slide members being pressed by spring force of a spring member and the shaft section being positioned at the end of the cylindrical member where the stopper has been cut out.

11. The connector according to claim 1, wherein the opening of the cylindrical member is a first opening, and the end of the cylindrical member is a first end, wherein the slide member is a first slide member, wherein the operation member is a first operation member, and wherein the connector further comprises:

a second opening provided at a second end of the cylindrical member along the axial direction;

a second slide member arranged within the cylindrical member; and a second operation member attached to the second slide member.

12. The connector according to claim 11, wherein the first operation member is attached to the first slide member by welding with a laser beam, and wherein the second operation member is attached to the second slide member by being screwed thereinto.

13. A band comprising:

a band attachment portion provided on a case; and the connector according to claim 9, wherein the connector is attached to the band attachment portion.

14. The band according to claim 13, wherein the first operation member and the second operation member are exposed from cutout sections provided in side portions of the band attachment portion.

15. A band comprising the connector according to claim 1.

16. A timepiece comprising the connector according to claim 1.

17. The connector according to claim 1, wherein an axial length of the opening of the cylindrical member is equal to or shorter than an axial length of the large-diameter portion of the slide member, wherein an outer diameter of the large-diameter portion is shorter than an inner diameter of the cylindrical member and the axial length of the large-diameter portion is one-third of an axial length of the cylindrical member, and wherein an outer diameter of the small-diameter portion is shorter than the outer diameter of the large-diameter portion and an axial length of the small-diameter portion is half the axial length of the large-diameter portion.

18. The connector according to claim 1, wherein, in the opening of the cylindrical member, when the small-diameter portions of a pair of the slide members are pressed into the cylindrical member against spring force of a spring member, a shaft section of the operation member is positioned close to or come in contact with a middle side of the cylindrical member in the axial direction.

* * * * *